United States Patent [19]

Jackson et al.

[11] 4,322,703

[45] Mar. 30, 1982

[54] ELECTRICAL SWITCH AND ACTUATOR THEREFOR HAVING BOTH LINEAR AND ANGULAR ADJUSTMENT THEREBETWEEN

[75] Inventors: Leigh F. Jackson, Guilford; Niles J. Martin, Bonneaville, both of Pa.

[73] Assignee: Westinghouse Electric Corp., Pittsburgh, Pa.

[21] Appl. No.: 171,788

[22] Filed: Jul. 24, 1980

[51] Int. Cl.[3] ..... H01H 9/00

[52] U.S. Cl. ..... 335/205; 200/61.44

[58] Field of Search ..... 335/205-207; 187/29 R; 200/61.44, 153 R, 331, 47, 84 C

[56] References Cited

U.S. PATENT DOCUMENTS

| | | | |
|---|---|---|---|
| 3,261,427 | 7/1966 | Morris | 187/29 R |
| 4,209,109 | 6/1980 | Curl | 335/205 |
| 4,213,110 | 7/1980 | Holce | 335/205 |

*Primary Examiner*—Gerald P. Tolin

*Attorney, Agent, or Firm*—D. R. Lackey

[57] ABSTRACT

An electrical switch and actuator therefor, arranged for relative movement. The switch is actuated in response to a predetermined positional relationship between the switch and actuator, with at least the mounting arrangement for the switch enabling both linear and angular adjustment of switch position. The adjustable mounting means for the switch additionally defines a wiring duct for the switch wires.

8 Claims, 6 Drawing Figures

ELECTRICAL SWITCH AND ACTUATOR THEREFOR HAVING BOTH LINEAR AND ANGULAR ADJUSTMENT THEREBETWEEN

BACKGROUND OF THE INVENTION

1. Field of the Invention

The invention relates in general to electrical switches and actuators therefor which are arranged for relative movement, requiring precise relative positioning for proper switch operation.

2. Description of the Prior Art

Certain types of applications for electrical switches require that a switch operate to indicate positional relationship of a moving object relative to a stationary object. Thus, the electrical switch and actuator therefor are mounted for relative movement, with either the switch or actuator being carried by the movable object. The other element of the combination is mounted on the stationary object.

A typical application for such a switch/actuator arrangement is for the translating device used in elevator systems for detecting the position of an elevator car in its hoistway. The elevator system requires this positional information in order to properly control the operation of the elevator car, or cars. Examples of such switch/actuator arrangements include (a) an arrangement for producing a light beam which is interrupted by an actuator, (b) mechanical switches with cam followers which are operated by a cam actuator, (c) a magnetic switch in the form of an inductor relay, with the inductor relay having an incomplete magnetic circuit, which is completed by an actuator in the form of a plate or vane constructed of magnetic material. Close proximity of the magnetic switch and vane completes the magnetic circuit to operate the switch, and (d) magnetic switches, such as reed switches, which are operated from one position to another position while being subjected to a magnetic field, such as from a permanent magnet actuator. All of these arrangements require accurate positioning and alignment of the various elements for proper operation, with the magnetic switch/actuator arrangements requiring perhaps the most precise positioning, especially when the switch is operated through a flat non-magnetic cover by a flat magnetic plate actuator member. This latter arrangement requires both the spacing and angular positioning of the two flat surfaces to be precisely adjusted. This adjustment between the magnetic switch, which is usually mounted on the elevator car, and the magnetic vanes, which are usually mounted in the hoistway, is thus very tedious and time consuming, and it would be desirable to provide a new and improved switch/actuator arrangement which permits quick and precise adjustment of the relative positions of these two components.

SUMMARY OF THE INVENTION

Briefly, the present invention is a new and improved electrical switch and actuator arrangement suitable for an application wherein they are mounted for relative movement. The electrical switch includes a mounting arrangement which permits both linear and angular adjustment thereof, with the mounting arrangement also defining a completely enclosed wiring duct for the switch wires. The linear and angular positional adjustments do not require the rotation of any component associated with the switch or its housing, thus enabling such adjustments to be made without requiring the twisting of the electrical wires.

The actuator includes a mounting arrangement which permits both linear and angular adjustment thereof. When the actuator is in the form of a flat vane having a flat plane surface, the linear and angular adjustment are both made through access openings provided in the actuator, enabling them to be easily made from the elevator car when the actuators are mounted in an elevator hoistway.

BRIEF DESCRIPTION OF THE DRAWING

The invention may be better understood, and further advantages and uses thereof more readily apparent, when considered in view of the following detail description of exemplary embodiments, taken with the accompanying drawings in which.

DESCRIPTION OF PREFERRED EMBODIMENTS

While the switch arrangement of the invention may be used in many different applications, for purposes of example it will be described as it would be used in an elevator system. Also, for purposes of example, it will be assumed that the switch/actuator arrangement requires precise parallel alignment and spacing of two flat, plane surfaces, as required by a magnetic switch and actuator vane constructed of magnetic material, since the relative positioning of these components is very critical.

Figure 1:
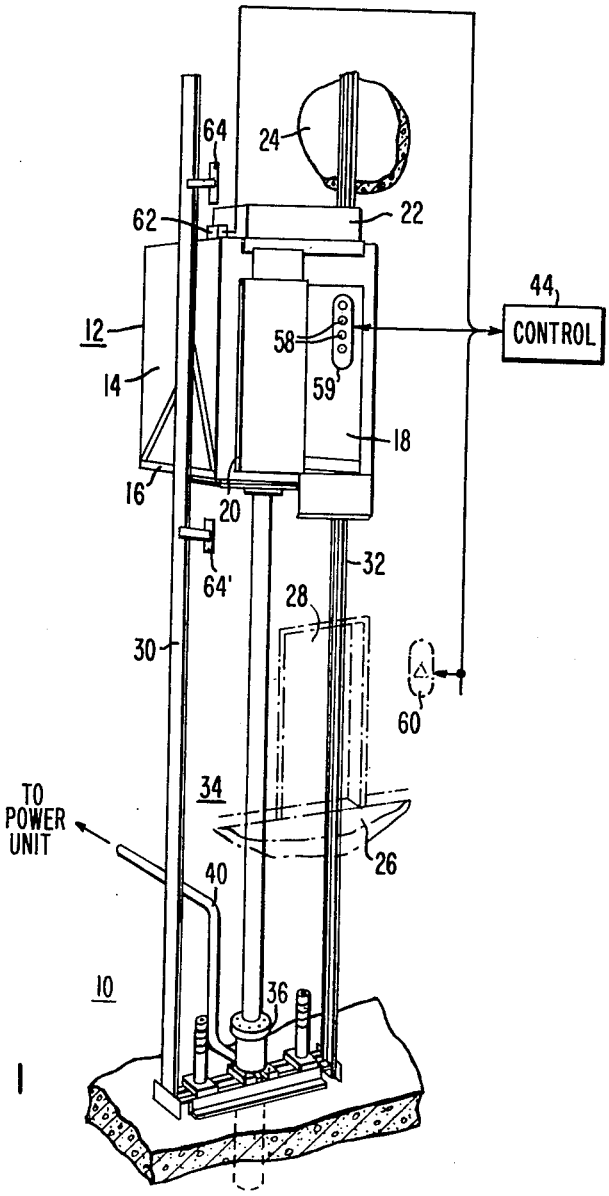
FIG. 1 is a perspective view of an elevator system which may utilize switch/actuator arrangements constructed according to the teachings of the invention.

Referring now to the drawings, and to FIG. 1 in particular, there is shown an elevator system 10 which may utilize electric switch/vane assemblies constructed according to the teachings of the invention. Elevator system 10, which may be a hydraulic elevator as illustrated, or an electric traction elevator, includes an elevator car 12 comprising a passenger cab 14 mounted on a sling and platform assembly 16. Cab 14 defines a passenger compartment, which has an opening 18, a door 20 for the opening, and a door operator 22 which slidably operates door 20 between the open position illustrated in FIG. 1 and a closed position.

Elevator car 12 is mounted for guided vertical movement in the hoistway 24 of a structure or building having floors to be served by the elevator car, such as floor 26 shown in phantom. Floor 26 includes a hoistway door 28 which is operated in unison with the car door 20 when the elevator car 12 is located at floor 26.

Elevator car 12 is guided and stabilized in its vertical travel path via guide rails 30 and 32 suitably attached to the walls of hoistway 24 via rail brackets (not shown) and guide roller assemblies (not shown) on the elevator car 12 which co-act with the guide rails. Motive means for elevator car 12 includes a hydraulic system 34 comprising a jack assembly 36, a hydraulic power unit (not shown), and suitable piping 40 which provides fluid flow communication between the power unit and jack assembly 36. An electrical control panel 44, usually mounted on the power unit, includes the car control and power unit control, such as a line contactor, door relays, direction relays, and a floor selector.

Elevator car 12 is controlled in response to calls for elevator service, such as may be initiated via car call pushbuttons 58 mounted in a car station 59 in the passenger compartment of cab 14, and via hall call pushbuttons, such as pushbutton 60, located in the hallways of the various floors, and in response to car position translating means. The car position translating means includes an electrical switch assembly 62 mounted on the elevator car 12, and a plurality of actuators for switch assembly 62 which are fixed in hoistway 24, such as actuator vane assemblies 64 and 64'.

Figure 3:
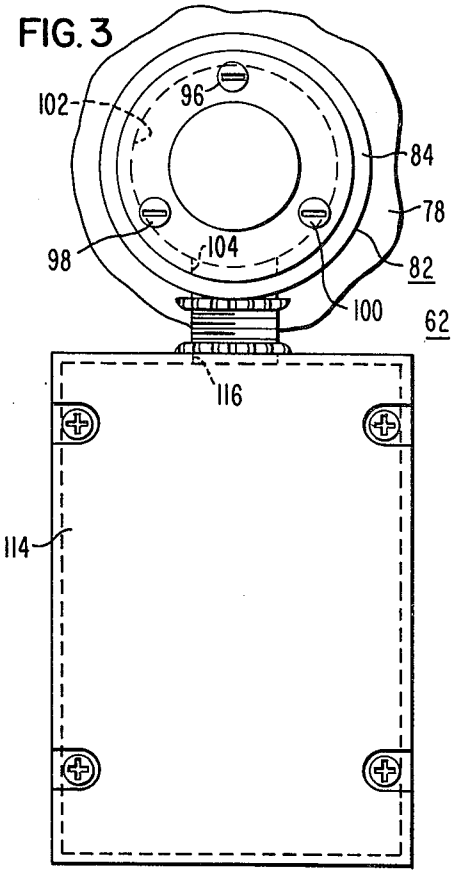
FIG. 3 is an end elevational view of the electrical switch assembly shown in FIG. 2.
Figure 2:
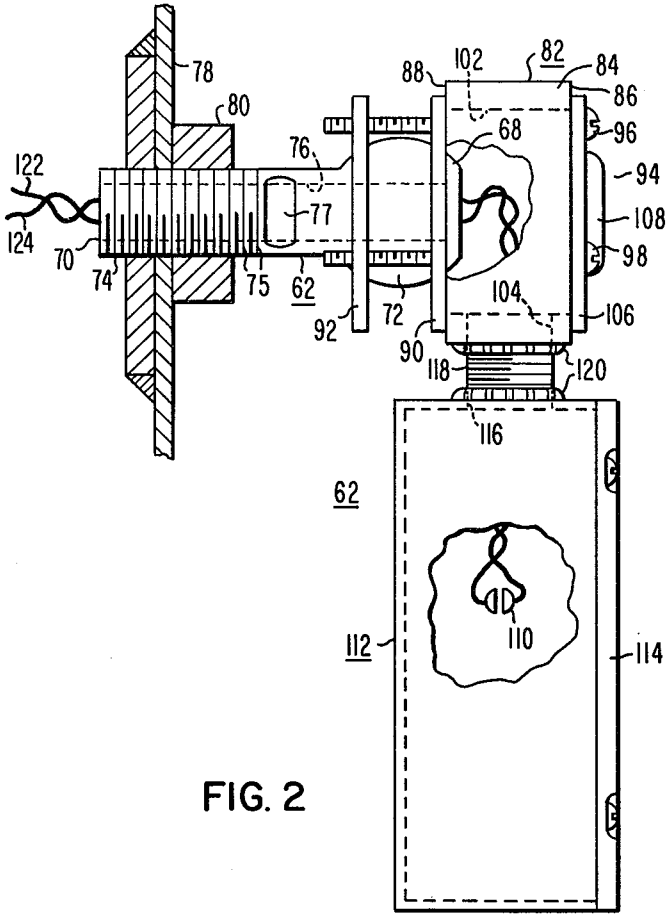
FIG. 2 is a view in side elevation of an electrical switch assembly having a mounting arrangement constructed according to the teachings of the invention.

FIGS. 2 and 3 are elevational side and end views, respectively, of electrical switch assembly 62 shown in FIG. 1, illustrating the mounting thereof according to the teachings of the invention, which provides both linear and angular adjustment thereof. The electrical switch assembly 62 includes an elongated rod member 66 having first and second ends 68 and 70, respectively, with the first end 68 having an integral spherical ball portion 72, and with the second end 70 defining a shank portion 74 having a plurality of threads 75 which start at its second end 70. Rod member 66 also includes an opening 76 which extends coaxially with its longitudinal dimension between its first and second ends 68 and 70, respectively, and a non-round cross-sectional configuration located between ball portion 72 and threads 75, such as flats disposed on opposite sides thereof, indicated by flat 77. The non-round cross-sectional configuration enables a wrench to be used to turn rod member 66 in, or out, for linear adjustment thereof.

Rod member 66 is threadably engaged with a suitable support member, such as the reinforced panel member 78 illustrated in FIG. 2, and a lock nut 80 disposed on rod member 66 enables any selected linear position of rod member 66 to be fixed by tightening nut 80 against panel member 78.

Switch assembly 62 further includes a swivel mounting base assembly 82. Mounting base assembly 82 includes a tubular member 84 having first and second ends 86 and 88, respectively. A swivel base plate 90, a retainer plate 92, a cover assembly 94, and a plurality of threaded fasteners, such as screws 96, 98 and 100. Tubular member 84 defines an opening 102 which extends between its ends, providing an access opening at its second end 88 and an access opening at its first end 86 covered by cover assembly 94, and it additionally includes an access opening 104 disposed through its side wall portion.

Cover assembly 94 may include a washer-like plate member 106 having a removable cap 108 snapped into its central opening.

The swivel base plate 90 and retainer plate 92 may also be washer-like members which include central openings having a predetermined diameter, which is larger than the O.D. of the shank portion 74 and less than the O.D. of ball portion 72. All of the washer-like members, including cover plate 106, base plate 90 and retainer plate 92, have a like number of like positioned openings for receiving screws 96, 98 and 100, with only the openings in retainer plate 92 being tapped.

In the assembly of the swivel mounting base assembly 82, the cover plate 106 and retainer plate 90 are disposed against the first and second ends 86 and 88, respectively, of tubular member 84, the screws 96, 98 and 100 are disposed through the openings in the plates 106 and 90, and the central opening in the retainer plate 90 is interfaced with the spherical surface of ball portion 72. The retainer plate 92 is telescoped over the shank or second end 70 of rod member 62, prior to its assembly with the lock nut 80 and support 78, with its central opening interfacing with the spherical surface of ball portion 72. It will be noted that plate members 90 and 92 are disposed on opposite sides of the geometric center of the ball portion 72. The screws 96, 98 and 100 are threadably engaged with the tapped openings in the retainer plate 92 and they are threadably advanced to provide a pre-load which enables the swivel mounting base assembly 82 to be moved angularly over the spherical surface of ball portion 72, and to retain any selected position. Further tightening of screws 96, 98 and 100 will fix the finally selected angular position.

An electrical switch, indicated generally by contact 110, is mounted in a switch box 112. Switch box 112 includes a non-magnetic cover 114 disposed to cover the major opening to the switch box 112, and an additional access opening 116. Switch box 112 is mechanically connected to the swivel mounting base assembly 82 with its access opening 116 disposed in communication with access opening 104 and tubular member 84, such as via a threaded pipe member 118 and lock nuts 120.

Electrical wires 122 and 124 for connection to electrical switch 110 start from within the panel member 78, which may function as a junction box, and they are fished through the longitudinal opening 76 in rod member 62 into the recess defined by opening 102 in tubular member 84. Cap 108 may be temporarily removed from the cover plate 106 to facilitate directing wires 122 and 124 through openings 104 and 116 into the switch box cavity for connection to switch 110.

It should be noted that screws 96, 98 and 100 may be loosened to the point where rod member 62 may be turned to provide linear positioning of switch assembly 112, without turning the swivel mounting base assembly 82. Thus, the wires 122 and 124 will not be subjected to any twisting action during such linear adjustment. Further, the wires 122 and 124 are not disturbed during angular adjustment of the swivel mounting base assembly 82, as it is moved over the spherical surface of ball portion 72.

Switch 110, in the disclosed embodiment, is a magnetic switch, which is disposed adjacent to the nonmagnetic cover plate 114. Close proximity of a magnetic plate or vane to cover 114 will cause switch 110 to operate from a first condition to a second condition, and removal of the plate or vane will cause switch 110 to operate back to its first condition. The first condition may be a normally open, or a normally closed, contact position, as desired.

Figure 5:
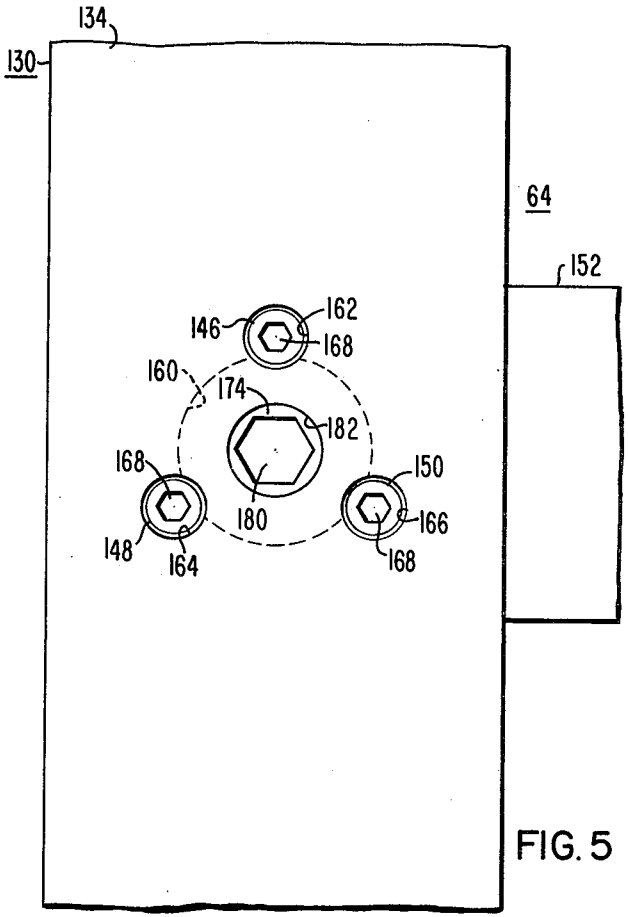
FIG. 5 is an end elevational view of the actuator assembly shown in FIG. 4, illustrating how positional adjustments are made through the vane from its operating or outwardly facing side.
Figure 4:
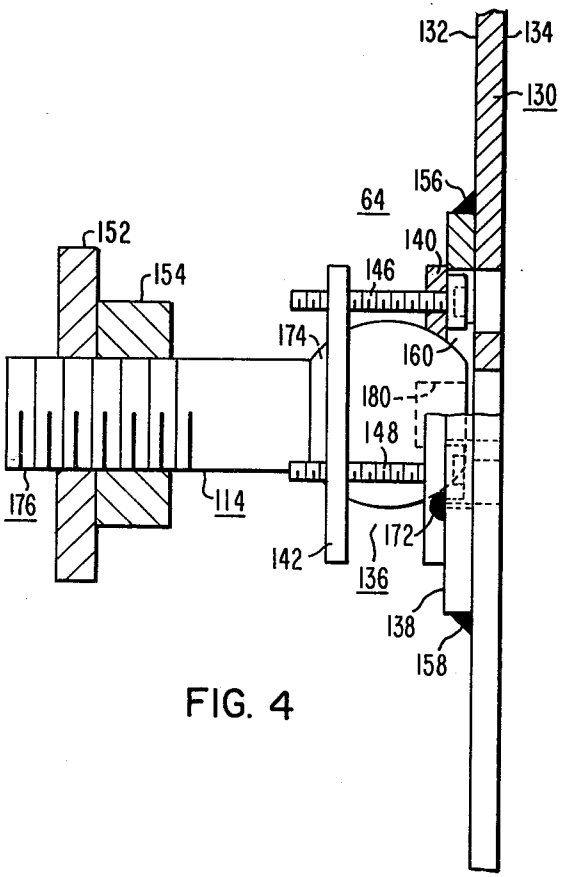
FIG. 4 is a view in side elevation of an actuator assembly for the electrical switch assembly shown in FIGS. 2 and 3, having a mounting arrangement constructed according to the teachings of the invention.

FIGS. 4 and 5 are side and front elevational views, respectively, of actuator vane assembly 64 shown in FIG. 1. Actuator vane assembly 64 includes a plate member 130 formed of a magnetic material, such as steel, with plate member 130 having first and second flat, major, opposed sides or surfaces 132 and 134, respectively.

Actuator vane or plate 130 is supported by a mounting assembly 136 which includes a spacer plate 138, a base plate 140, a retainer plate 142, a rod member 114, a plurality of threaded fasteners, such as screws 146, 148 and 150, a mounting arm member 152, and a lock nut 154.

Spacer plate 138 is centered and then fixed to side 132 of vane 130, such as by welding, indicated by weld beads 156 and 158. Spacer plate 138 includes a central opening 160 coaxial with the geometrical center of vane 130, and a plurality of additional openings for receiving screws 146, 148 and 150.

Vane 130 includes a plurality of openings 162, 164 and 166 aligned with the openings in the spacer plate 138, enabling the screws 146, 148 and 150 to be inserted into position from side 134 of vane 130, and to be turned from a position facing side or surface 134. As indicated, screws 146, 148 and 150 may be Allen head screws, having non-round recesses 168 for receiving a complementary shaped tool or Allen wrench.

Base plate 140 is a washer-like member having a central opening for interfacing with the rod member 114, and a plurality of additional openings for screws 146, 148 and 150. Base plate 140 may be centered and then welded to spacer plate 138, as indicated by weld beads 170 and 172, or, since it will be automatically held in position between rod member 114 and spacer plate 138, it may be loose.

Retainer plate 142 is a washer-like member having a central opening, and tapped openings for threadably receiving screws 146, 148 and 150.

Rod member 114 is an elongated member having a spherical ball portion 174 at one end and a threaded shank portion 176 which starts at its other end. A non-round recess 180 is disposed in ball portion 174, at the extreme end of rod member 114, coaxial with the longitudinal center line of rod member 114, such as a socket for receiving an Allen wrench. Actuator vane 130 includes an opening 182 which enables a tool to be inserted into recess 180 from side 134 of vane 130.

Retainer plate 142 is telescoped over the threaded shank end 176 of rod member 114, with its central opening interfacing with the spherical surface of ball portion 174. Lock nut 154 is then threadably engaged with shank portion 176. The vane 130, spacer plate 138, base plate 140, and screws 146, 148 and 150, all in assembled relation, are placed in position such that the central opening in base plate 140 interfaces with the spherical surface of ball portion 174. The threaded shank end 176 is then engaged with a tapped opening in the mounting arm member 152, which, as shown in FIG. 1, may be fixed to guide rail 130, such as via conventional rail clips.

Linear adjustment of vane assembly 64 may be made from the elevator car 14 either from within through a suitable lockable access panel, or by standing on top of the car, by inserting a suitable tool in recess 180 and turning rod member 114 in the desired direction. Screws 146, 148 and 150 may be relatively loose at this time. When the desired linear position of vane 130 is obtained, lock nut 154 is tightened to fix the selected position. Screws 146, 148 and 150 are then turned to provide a pre-load which enables the desired angular position of vane 130 to be achieved. Once achieved, screws 146, 148 and 150 are tightened to fix this angular position.

Figure 6:
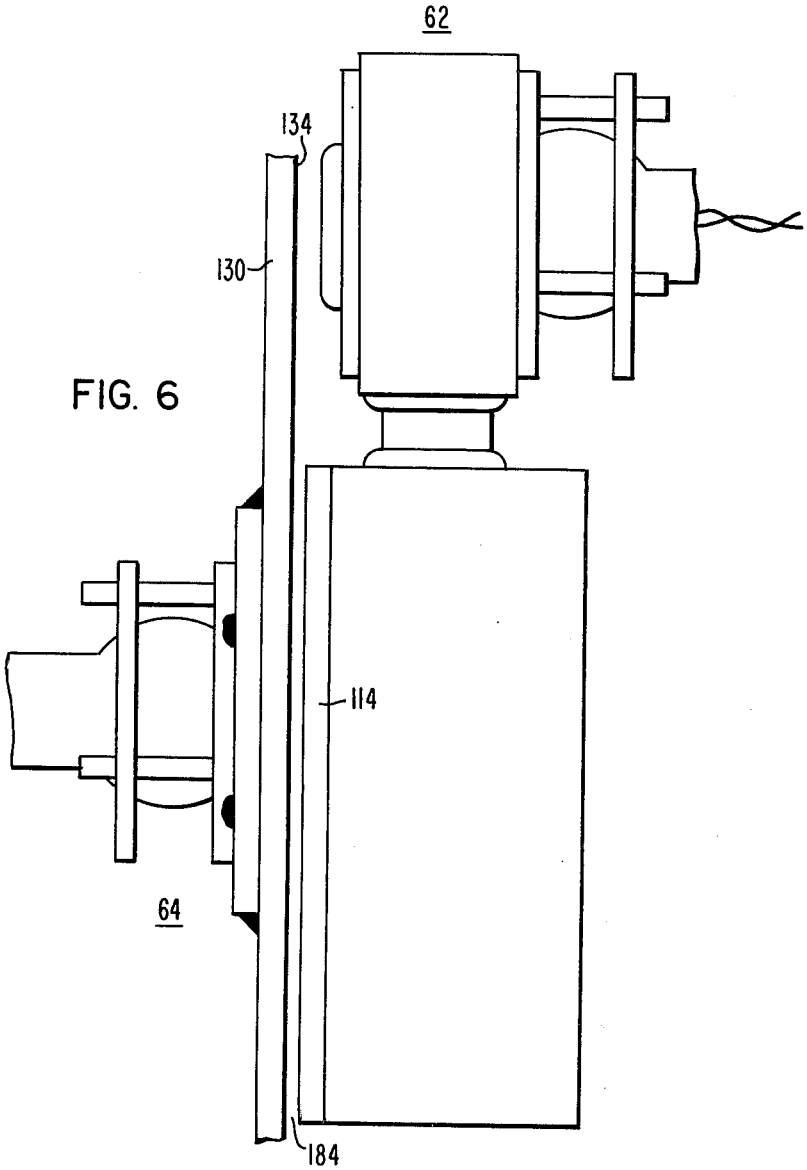
FIG. 6 is a side elevational view of the switch and actuator shown in FIGS. 2–5, illustrating the accurate spacing and angular alignment required for insuring correct operation.

FIG. 6 is a side view of switch assembly 62 and actuator vane assembly 64 disposed in the actuating position for the switch assembly 62. FIG. 6 clearly illustrates the close spacing 184 required for proper operation of switch 110, and the critical need for exact parallelism between the flat plane surfaces of cover 114 on switch box 112 and surface 134 of vane 130.

In summary, there has been shown a new and improved electrical switch and actuator arrangement which enables both linear and angular positional adjustment of at least the electrical switch assembly, and in a preferred embodiment, of both the electrical switch assembly and the actuator vane assembly. Further, the mounting arrangement for the electrical switch also defines a wiring duct which extends from the mounting point of the base assembly to the electrical contacts of the switch, which duct is completely enclosed, making it unnecessary to provide additional wiring and protective conduit. The linear and angular adjustments of the switch and actuator components may be quickly and easily made by an operator positioned within, or on top of the elevator car, with the adjustments to the van assembly being easily made because they are all made through access openings provided in the face of the vane which faces the elevator car.

We claim as our invention:

1. An electrical switch arrangement, including an elecrical switch and actuator means therefor, comprising:

a rod member having first and second ends, including a spherical ball portion at its first end, a threaded shank portion starting at its second end, and a longitudinal opening between its ends, mounting means for threadably receiving the threaded shank portion of said rod member, permitting the selection of a desired linear position for said rod member, and including means for fixing the selected position, a swivel base assembly including a housing portion defining a recess having at least first and second access openings, said swivel base assembly further including an adjustable portion mounted for pivotal movement over the spherical surface of said ball portion, with the first access opening in its housing portion being in communication with the longitudinal opening in said rod member, with said adjustable portion including means for fixing the selected angular position of said swivel assembly on said ball portion, a switch box having at least one opening therein, said switch box being fixed to said swivel base assembly with its at least one opening in communication with the second access opening in said housing portion, an electrical switch disposed in said switch box, electrical wires communicating with said electrical switch via the longitudinal opening in said rod member and the housing portion of said swivel base assembly, and actuator means for said electrical switch, said mounting means and said actuator means being disposed for relative movement therebetween, with said electrical switch being actuated in response to a predetermined positional relationship relative to said actuator means.

2. The electrical switch arrangement of claim 1 including mounting means for the actuator means which enables both linear and angular positional adjustment thereof.

3. The electrical switch arrangement of claim 1 wherein the electrical switch is a magnetic switch, and the actuator means is a vane formed of magnetic material.

4. The electrical switch arrangement of claim 1 wherein the adjustable portion of the swivel base assembly includes first and second spaced, parallel plate members having openings interfacing with the surface of the ball portion, on opposite sides of its geometrical center, and threaded fastener means interconnecting said plate members to permit adjustable preloading, and fixing, of said adjustable portion, on the ball portion.

5. The electrical switch arrangement of claim 1 wherein the shank portion of the rod member includes a non-round circumferential configuration at a predetermined location, to facilitate rotation thereof by a cooperatively configured tool, when linear positioning of the rod member is desired.

6. The electrical switch arrangement of claim 5 wherein the means fixing the selected linear position of the rod member includes a lock nut threadably engaged with the threaded shank which cooperates with the mounting means.

7. The electrical switch arrangement of claim 1 wherein the electrical switch is a magnetic switch and the actuator means is a vane having first and second major opposed sides constructed of magnetic material, and including linearly and angularly adjustable mounting means for the actuator means extending from its first side, said adjustable mounting means including a rod member having a spherical ball portion at one end and a threaded shank portion at the other, with said spherical ball portion including a recess having a non-round configuration coaxial with its longitudinal dimension, suitable for engagement with a like configured tool to effect rotation and thus linear adjustment, and including an access opening in said vane aligned with said recess, to permit access to said recess from the second major side of the magnetic vane.

8. The electrical switch arrangement of claim 7 wherein the linearly and angularly adjustable mounting means for the actuator means includes means cooperable with the ball portion of its rod member which is preloadable and fixable thereto via a plurality of threaded fasteners, and including openings in said vane aligned with said plurality of threaded fasteners, which permits operation thereof via a suitable tool from the second side of the vane member.

* * * * *